US011092375B2

(12) United States Patent
Benbow

(10) Patent No.: US 11,092,375 B2
(45) Date of Patent: Aug. 17, 2021

(54) FOOD STORAGE SYSTEM

(71) Applicant: Robin Benbow, Philadelphia, PA (US)

(72) Inventor: Robin Benbow, Philadelphia, PA (US)

( * ) Notice: Subject to any disclaimer, the term of this patent is extended or adjusted under 35 U.S.C. 154(b) by 113 days.

(21) Appl. No.: 16/372,026

(22) Filed: Apr. 1, 2019

(65) Prior Publication Data

US 2019/0301783 A1 Oct. 3, 2019

Related U.S. Application Data

(60) Provisional application No. 62/650,353, filed on Mar. 30, 2018.

(51) Int. Cl.

| | |
|---|---|
| ***F25D 3/08*** | (2006.01) |
| ***B65D 81/18*** | (2006.01) |
| ***B65D 21/02*** | (2006.01) |
| ***F25D 29/00*** | (2006.01) |
| ***F25D 23/02*** | (2006.01) |

(52) U.S. Cl.

CPC ..... *F25D 3/08* (2013.01); *B65D 21/0233* (2013.01); *B65D 81/18* (2013.01); *F25D 23/028* (2013.01); *F25D 29/003* (2013.01); *F25D 29/008* (2013.01); *F25D 2331/80* (2013.01); *F25D 2700/16* (2013.01)

(58) Field of Classification Search

CPC ..... B65D 21/0233; B65D 81/18; F25D 3/06; F25D 3/08; F25D 23/028; F25D 29/003; F25D 29/008; F25D 2331/80; F25D 2700/16

See application file for complete search history.

(56) References Cited

U.S. PATENT DOCUMENTS

| | | | | |
|---|---|---|---|---|
| 5,372,274 | A * | 12/1994 | Freedland | A47G 23/04 220/571 |
| 8,695,373 | B1 * | 4/2014 | Patton | F25D 3/08 62/457.6 |
| 2005/0051549 | A1 * | 3/2005 | Nelson | B65D 21/0219 220/23.83 |
| 2007/0144205 | A1 * | 6/2007 | Moore | F25D 3/08 62/457.6 |
| 2016/0272388 | A1 * | 9/2016 | Slack | B65D 25/14 |
| 2017/0336125 | A1 * | 11/2017 | Winkle | F25D 29/003 |
| 2018/0036202 | A1 * | 2/2018 | Wengreen | B65D 81/18 |
| 2018/0085250 | A1 * | 3/2018 | Weinstein | B65D 81/18 |
| 2018/0146808 | A1 * | 5/2018 | Dove | A47G 19/027 |

* cited by examiner

*Primary Examiner* — Marc E Norman

(74) *Attorney, Agent, or Firm* — Neal Blibo LLC; Arlene P. Neal

(57) ABSTRACT

A food storage system includes a plurality of bowls, a connection element configured to couple to at least two of the bowls, and a protection element configured to couple to the connection element. When two bowls are nested and coupled to the connection element, a void is formed between the two nested bowls and a refrigeration element is positionable in the void to maintain a predefined internal temperature in the food storage system.

15 Claims, 12 Drawing Sheets

FOOD STORAGE SYSTEM

CROSS-REFERENCE TO RELATED APPLICATIONS

The present application claims the benefit of U.S. Provisional Application Ser. No. 62/650,353 titled "Food Storage Systems," filed Apr. 2, 2018, which is incorporated by reference herein in its entirety.

BACKGROUND OF THE INVENTION

During warm and even hot weather, picnics and barbecues provide ample opportunity to enjoy friends, family, and food. But warm and hot weather also provide opportunities for foodborne bacteria to thrive. As food heats up, bacteria multiply. While bacteria exist everywhere in nature, when bacteria have nutrients (i.e. food), moisture, time, and high temperatures, bacteria will grow. Often bacteria will grow so rapidly that upon consumption of food infested with bacteria, the bacteria can cause various types of illnesses—with food poisoning being just one type of illness. Clearly, the rapid multiplication of bacteria in food is dangerous. In fact, it is one of the most common causes of food poisoning. While the symptoms and severity of food poisoning vary, depending on which bacteria has contaminated the food, understanding how to keep food at a safe temperature is critical.

Bacteria grow most rapidly when the temperature is between 40° and 140° F. Between these two temperatures, bacteria have been known to double in as little as 20 minutes. This range of temperatures is called by many the "Danger Zone." A general rule for most meat is to never leave food out—without refrigeration—for longer than 2 hours. But when the temperature rises above 90° F., the general rule is for food to never be left out for more than 1 hour. While these rules provide general guidelines, they do not fully address the issues of keeping food at safe temperatures.

To keep food at safe temperatures, especially during summer-time picnics and barbecues, typically means toting a number of coolers packed with ice and gel packs. Federal guidelines in the United States, recommend storing food at 40° F. or below to prevent bacterial growth. Other safe practices include limiting the exposure of food to warm outdoor temperatures and keeping coolers closed as much as possible. While these guidelines generally assure temperatures will not veer outside of the recommended safety zones, there is a clearly a need for improved food storage systems, and a particular need for food storage systems that incorporate refrigeration elements and eliminate the need to tote ice and a vast number of gel packs.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
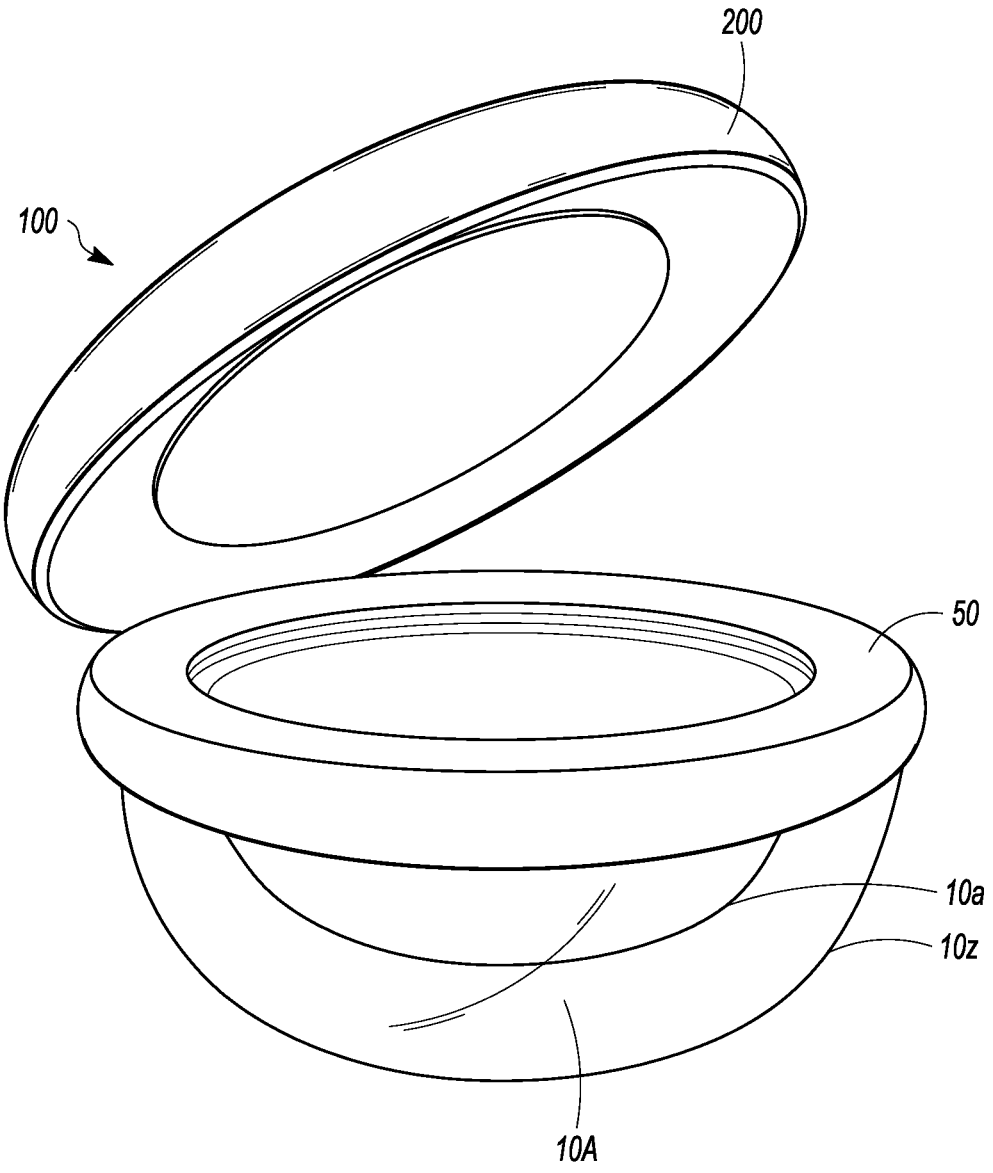
FIG. 1 shows a front perspective view of a food storage system including a plurality of nestable bowls in accordance with some embodiments.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

An embodiment includes a food storage system comprising a plurality of bowls. The food storage system also includes a connection element configured to couple to at least two of the bowls and a protection element configured to couple to the connection element. When two bowls are nested and coupled to the connection element, a void is formed between the two nested bowls and a refrigeration element is positionable in the void to maintain a predefined internal temperature in the food storage system. The combination of elements in the food storage systems, as described herein, is intended to keep food contained within the food storage system below or at a temperature safe for human consumption, particularly when the food is exposed to high temperatures.

FIG. 1 is shows a front perspective view of an embodiment of a food storage system 100 including a plurality of nestable bowls (i.e., bowls 10*a*-10*z*, although for simplicity only bowls 10*a* and 10*z* are shown in FIG. 1), a connection element 50 configured to couple to at least two of the nestable bowls 10*a*-10*z* and a protection element 200 configured to couple to the connection element 50. When at least two of bowls 10*a*-10*z* are nested, voids (i.e., 1*a*-1*z*, although for simplicity only void 1*a* is shown in FIG. 1) are formed between the nested bowls 10*a*-10*z*. One or more refrigeration elements 300 may be positionable in voids 1*a*-1*z* formed between nestable bowls 10*a*-10*z*, as further described herein.

In FIG. 1, the food storage system 100 includes an innermost nestable bowl 10*a* and an outermost nestable bowl 10*z*. However, as would be understood by one of ordinary skill in the art, the food storage system 100 can include more than two nestable bowls. For example, the food storage system 100 could include three or more nestable bowls, including an innermost bowl 10*a*, one or more interior bowls (e.g., 10*b*-10*y*) (not shown), and an outermost bowl 10*z*. The bowls 10*a*-10*z* are nested together such that one or more voids (e.g. 1*a*) are formed between the nested bowls 10*a*-10*z*, as shown, for example in FIGS. 1-3. To keep foods cold, a refrigeration element 300 comprising freezable substance for example, cold packs having gels or other freezable substances may be positionable between the nestable bowls 10*a*-10*z* and contained within the voided areas 1*a*-1*z*.

Each element of the food storage system disclosed herein may be manufactured from a food-grade, light-weight material, such as metal-based or plastic-based materials including moldable thermoplastic materials. Types of thermoplastic materials include, but are not limited to, Nylons, Polyethylene Terephthalate (PET-P), Polycarbonate, Acrylonitrile Butadiene Styrene, Modified Polyphenylene Oxide (PPO), Polybutylene terephthalate (PBT), Acetal, Polypropylene, Polyurethane, Polyetheretherketone (PEEK), Ultra-high molecular weight polyethylene (UHMW-PE), Polyetherimide, High Density Polyethylene (HDPE), Low Density Polyethylene(LDPE), High Impact Polystyrene, and Polysulfone, Polyvinylidene fluoride (PVDF).

One or more elements of the food storage system, for example, one or more of the nestable bowls 10, the connection element 50, and/or the protection element 200 may be manufactured from or coupled to one or more materials that include a temperature indicator. The element(s) of the food storage system that are manufactured from or coupled to the temperature indicator material are configured to provide an alert when the temperature in one or more of the nestable bowls rises above a predefined threshold. For example, the element(s) of the food storage system that are manufactured from or coupled to the temperature indicator material are configured to provide an alert when the temperature in one or more of the nestable bowls rises above 40° F. The alert provided from element(s) manufactured from the temperature indicator material may be, for example, a visual indicator wherein the temperature indicator material could change color when the temperature in one or more of the nestable bowls rises above the predefined threshold. The alert provided from element(s) coupled to a temperature indicator material (for example, a thermometer (not shown)) may be an audible or visual signal transmitted from the food storage system when the temperature in one or more of the nestable bowls rises above the predefined threshold.

Figure 2:
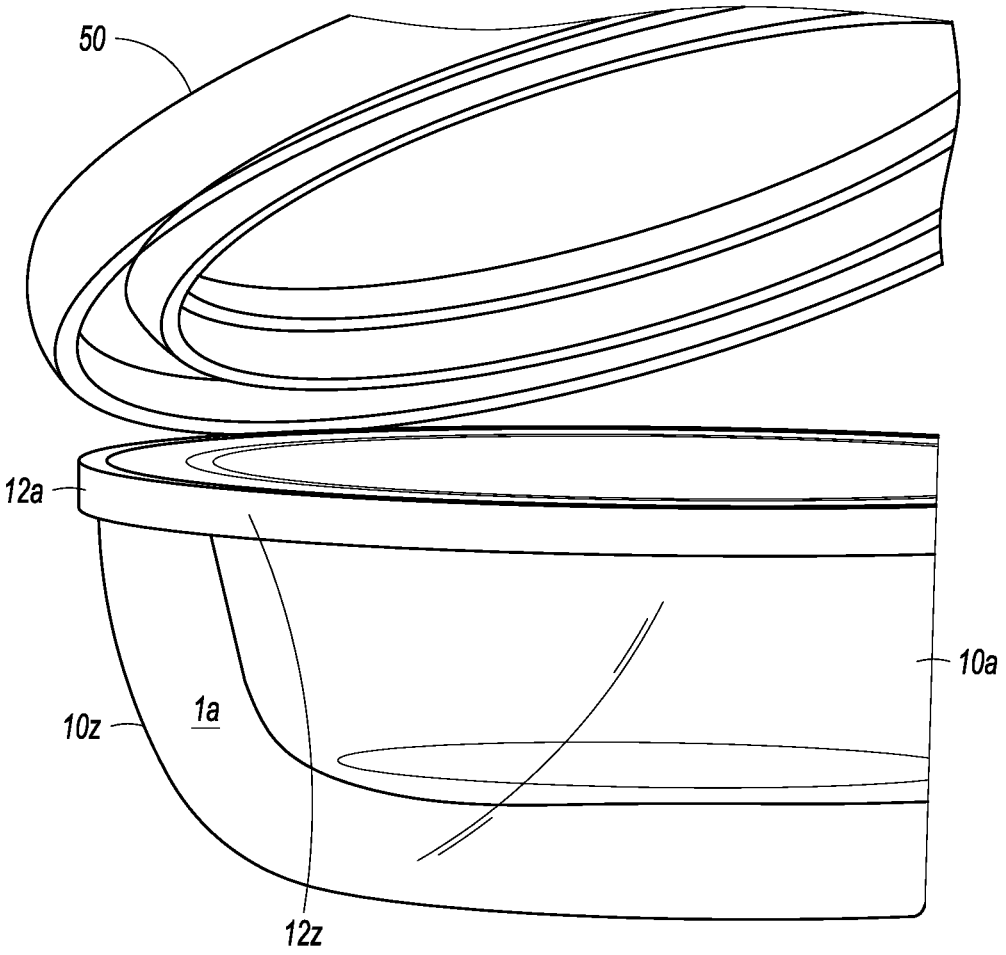
FIG. 2 shows a front perspective view of the plurality of nestable bowls and a connection element in accordance with some embodiments.
Figure 3:
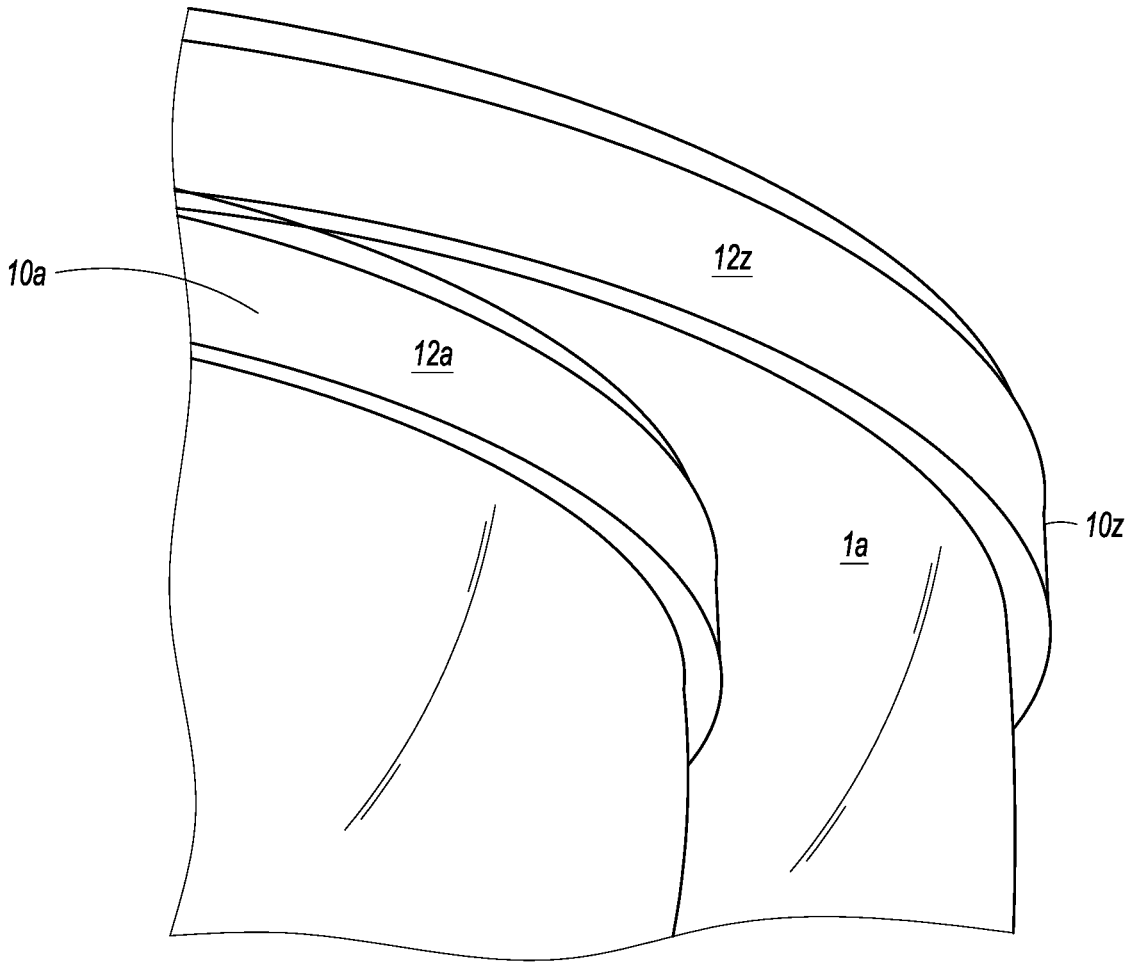
FIG. 3 shows an exploded partial side perspective view of the plurality of nestable bowls in accordance with some embodiments.
Figure 4:
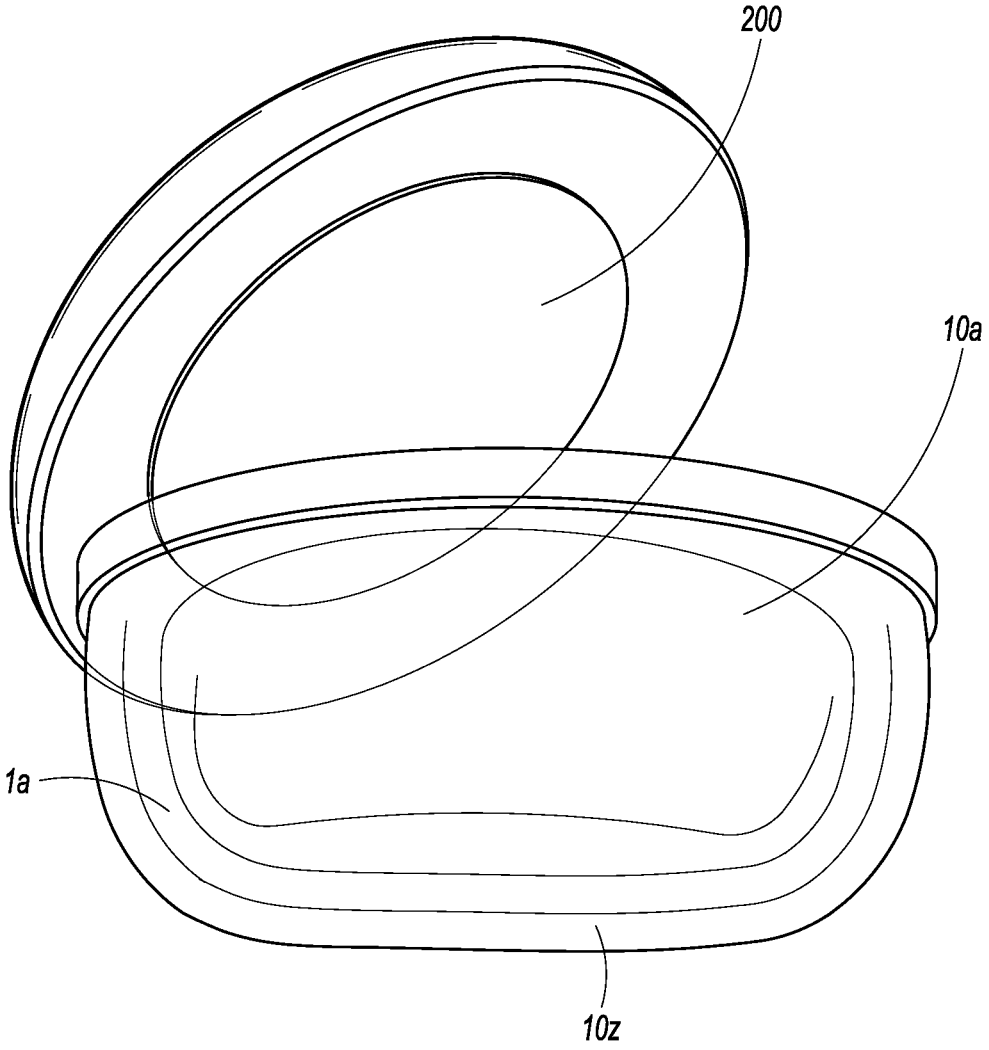
FIG. 4 shows a front perspective view of a plurality of nestable bowls and a protection element couplable to the plurality of nestable bowls in accordance with some embodiments.

FIG. 2 shows a front perspective view of nestable bowls 10*a* and 10*z* and the connection element 50 in accordance with some embodiments. FIG. 3 shows an exploded partial side perspective view of the nestable bowls 10*a* and 10*z* in accordance with some embodiments. FIG. 4 shows a front perspective view of the plurality of nestable bowls 10*a* and 10*z* and the protection element 200 couplable to the nestable bowls 10*a* and 10*z* in accordance with some embodiments.

In FIGS. 2 and 3, each of nestable bowls 10*a* and 10*z* includes an annular element 12*a* and 12*z*. It should be noted that one or more interior bowls (e.g., 10*b*-10*y*) (not shown) nested between bowls 10*a* and 10*z* may also each include an annular element 12*b*-12*y*. Each annular element 12 acts as a point of connection for coupling an associated nestable bowl 10*a*-10*z* with the connection element 50.

Figure 5:
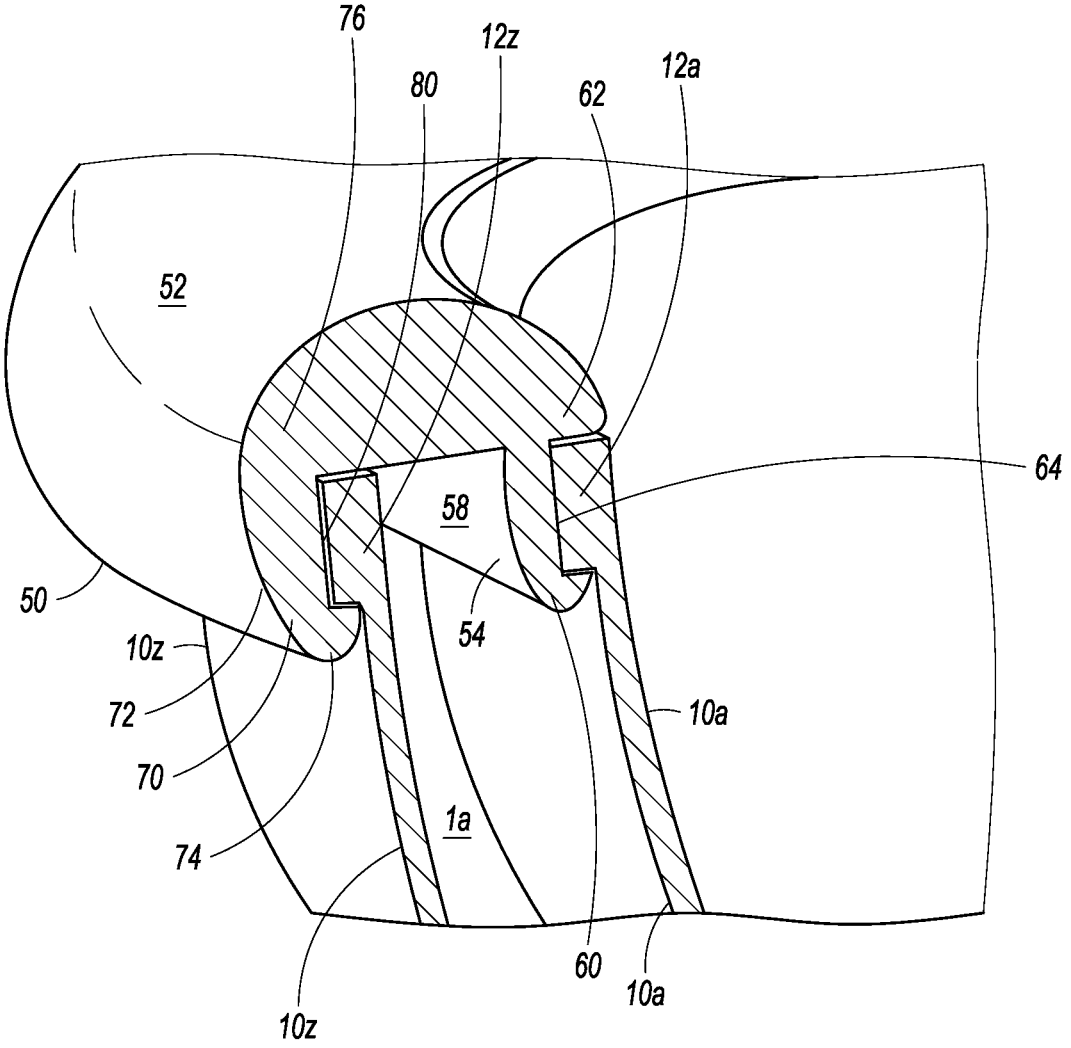
FIG. 5 shows a cross-sectional view of a plurality of nestable bowls coupled to the connection element in accordance with some embodiments.
Figure 6A:
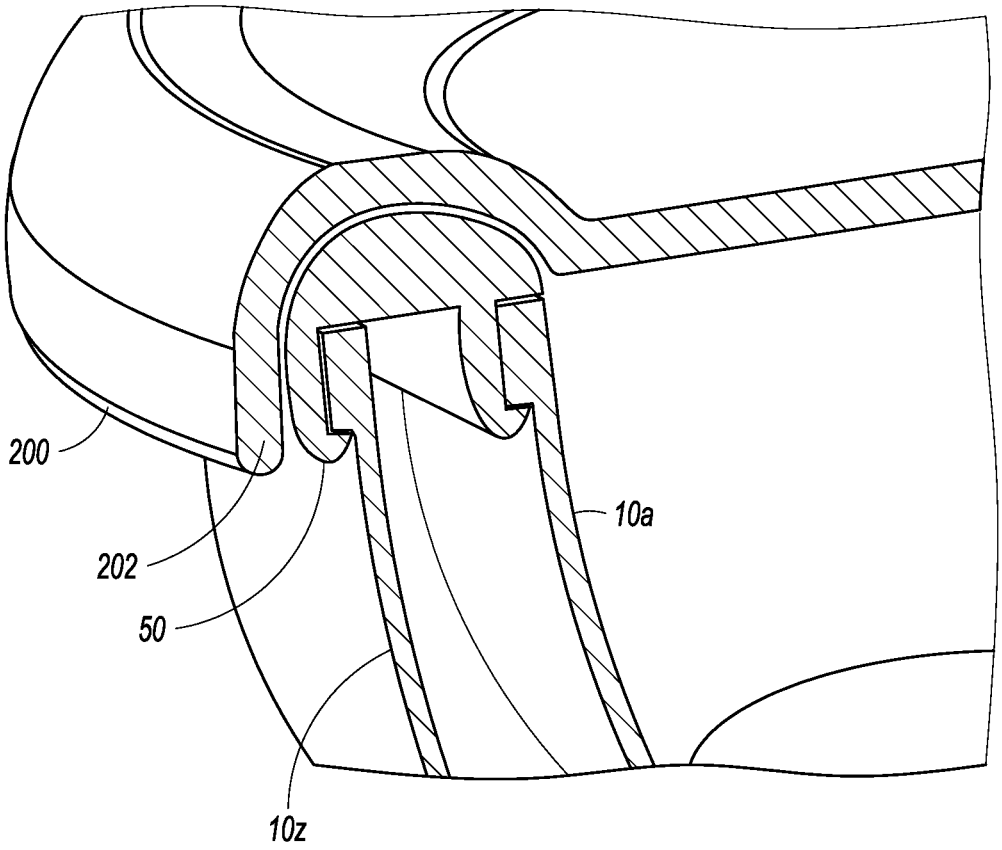
FIG. 6A-6C show cross-sectional views of a plurality of nestable bowls coupled to the connection element or the protection element and the protection element coupled to the connection element in accordance with some embodiments.
Figure 6B:
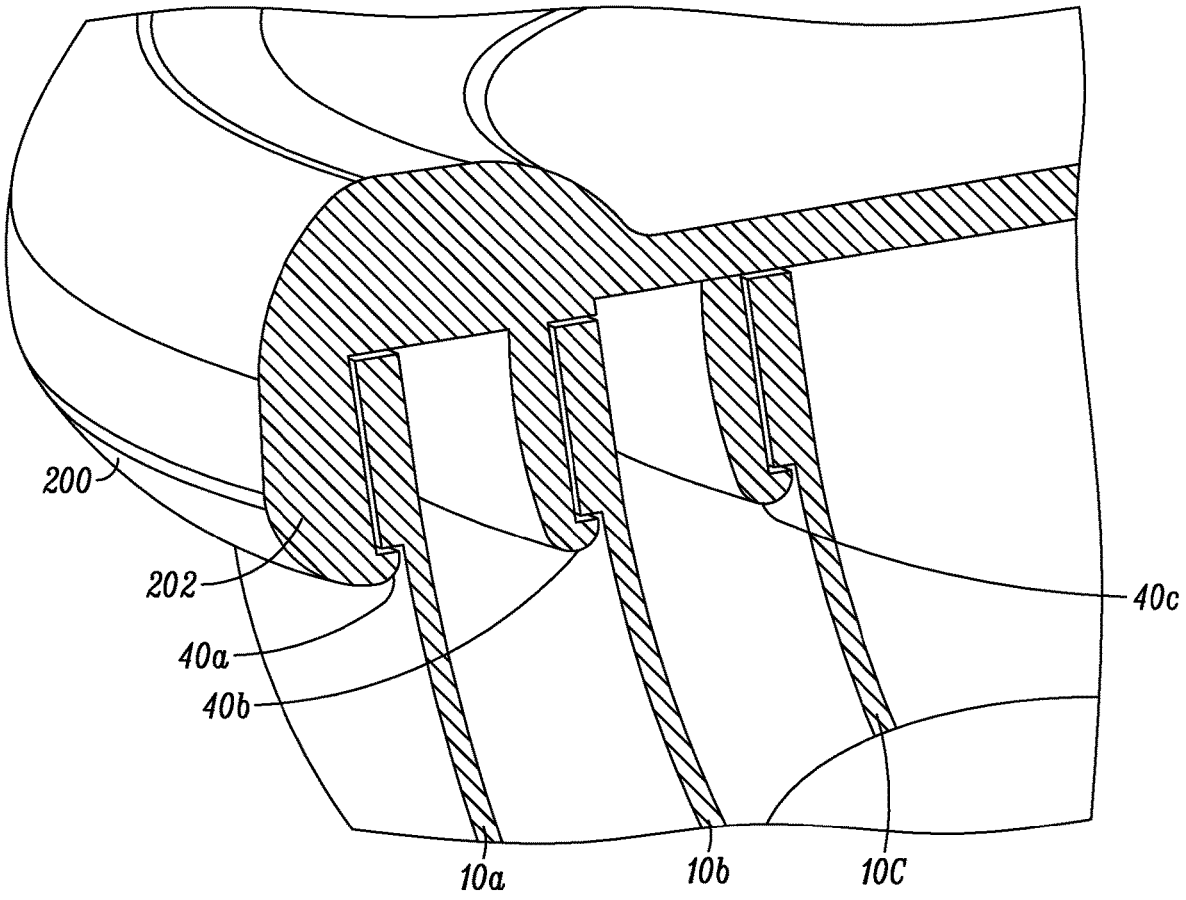
Figure 6C:
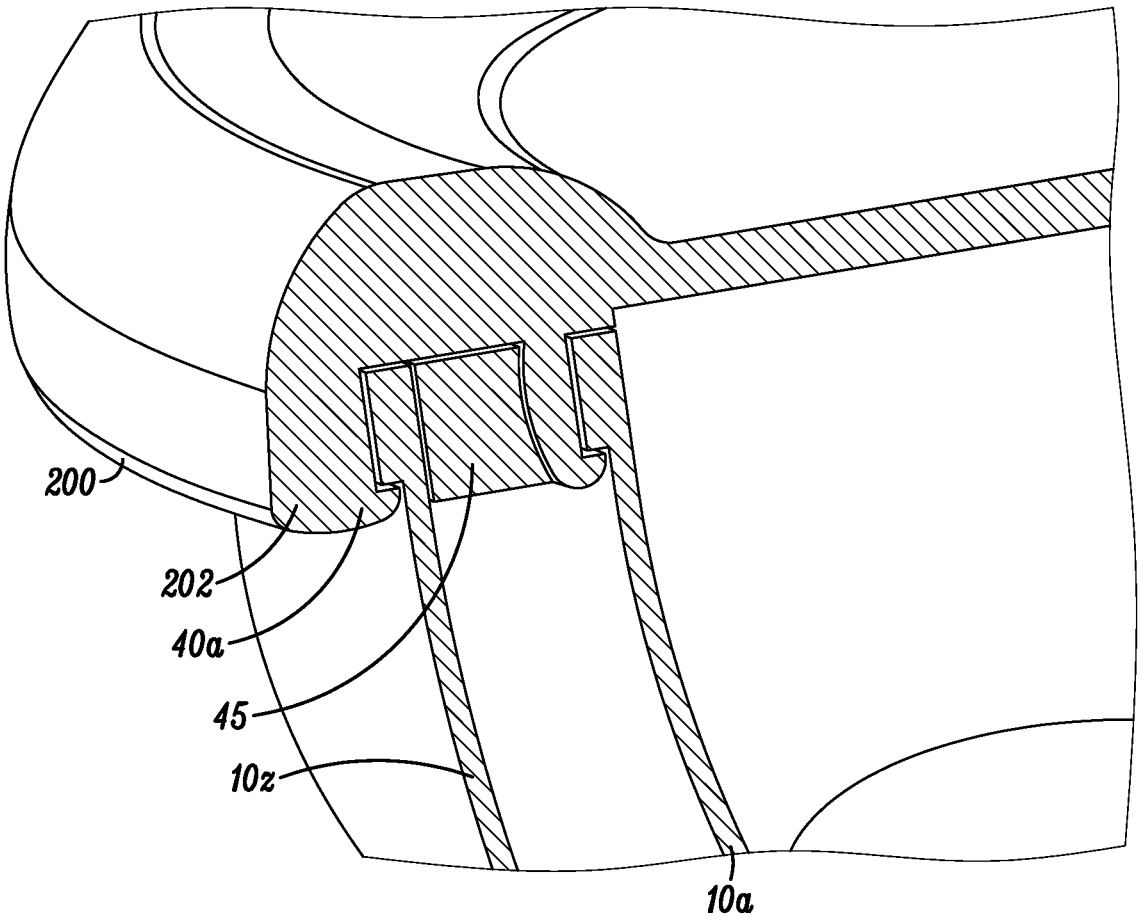

In one embodiment, as shown in FIGS. 1, 2, 5, and 6A-6C, the connection element 50 is configured for a snap-like connection with the nestable bowls 10*a*-10*z*. In particular, the connection element 50 is configured to connect with the annular elements 12*a*-12*z* of each nestable bowl 10*a*-10*z* such that a void 1*a*-1*z* is disposed between two nested bowls 10*a*-10*z*. In another embodiment, the connection element may be, for example, a gripping member having grooves or notches (40*a*-40*c*), each of which is configured to connect with an annular element 12 for positioning the nestable bowls 10*a*-10*z*, such that voids 1*a*-1*z* are formed when the bowls 10*a*-10*z* are nested. The gripping member may be formed of metal or plastic and may be attachable to protection element 200, as shown in 6B. The gripping member may be dynamically configured such that the notches or grooves of the gripping member may be increased (as shown in FIG. 6B or decreased (as shown in FIG. 6C) depending on the number of bowls being nested.

During assembly of the overall food storage system 100, as shown in FIG. 1, a refrigeration element 300 or another freezing element will first be positioned in the void 1*a* (as further described herein). After positioning of the refrigeration element 300 or another type of freezing element, the innermost nestable bowl 10*a* is positioned, and then the connection element 50 is positioned over the annular elements 12*a* and 12*z* of the nestable bowls 10 and, 10*z*. The connection element 50, as shown in FIG. 1, preferably includes a top outermost surface 52, which is positionable within at least a portion of the protection element 200.

FIG. 5 shows a cross-sectional view of the nestable bowls 10*a* and 10*z* coupled to the connection element 50 in accordance with some embodiments. In addition to the top outermost surface 52, the connection element 50 includes at least two coupling elements 54, 70. The innermost coupling element 54 has a downwardly extending annular element 58, having an innermost annular lip 60 and an inner annular extension 62. Together, the annular lip 60 and the inner annular extension 62 are positioned within the connection element 50 such that an innermost annular groove 64 is formed in the connection element 50.

Similarly, the second coupling element 70 of the connection element 50 has a downwardly extending, outermost extending annular element 72, having an outermost annular lip 74. The connection element also includes an interior annular surface 76. Together with the downwardly extending, outermost extending annular element 72, the interior annular surface 76 forms an outermost groove 80. The outermost groove 80 of the connection element 50 is positioned such that the annular element 12*z* of the outermost bowl 10*z* fits within the outermost annular groove 80. Similarly, the innermost annular groove 64 is positioned such that the annular element 12*a* of the innermost nested bowl 10*a* fits within the innermost annular groove 64.

FIG. 6A shows a cross-sectional view of the nestable bowls 10*a* and 10*z* coupled to the connection element 50, shown in FIG. 5, and the protection element 200 coupled to the connection element 50. The connection element 50 is shown being positionable within the protection element 200. The protection element 200 serves to protect the content of the food contained within the storage system 100. The protection element 200 is preferably formed, as shown in FIG. 6A, to include an annular grooved section 202, which is positionable over the connection element 50. However, as shown in FIG. 4, the protection element 200 may be positionable directly over a plurality 10 of nested bowls, for example, when the nested bowls 10*a* and 10*z* are assembled with a gripping member having notches 40*a*-40*c*.

The protection element 200 may also include one or more annular sections 17*a*-17*z* configured to mate with annular elements 12*a* and 12*z* such that the bowls 10*a* and 10*z* may be nested by mating the annular sections 17*a*-17*z* of the protection element 200 directly with annular elements 12*a* and 12*z*. Moreover, the protection element 200 may comprise a plurality of nestable protection sections/members 19, having refrigeration elements 300 positionable within one or more annular grooved sections 17*a*-17*z*.

Figure 7A:
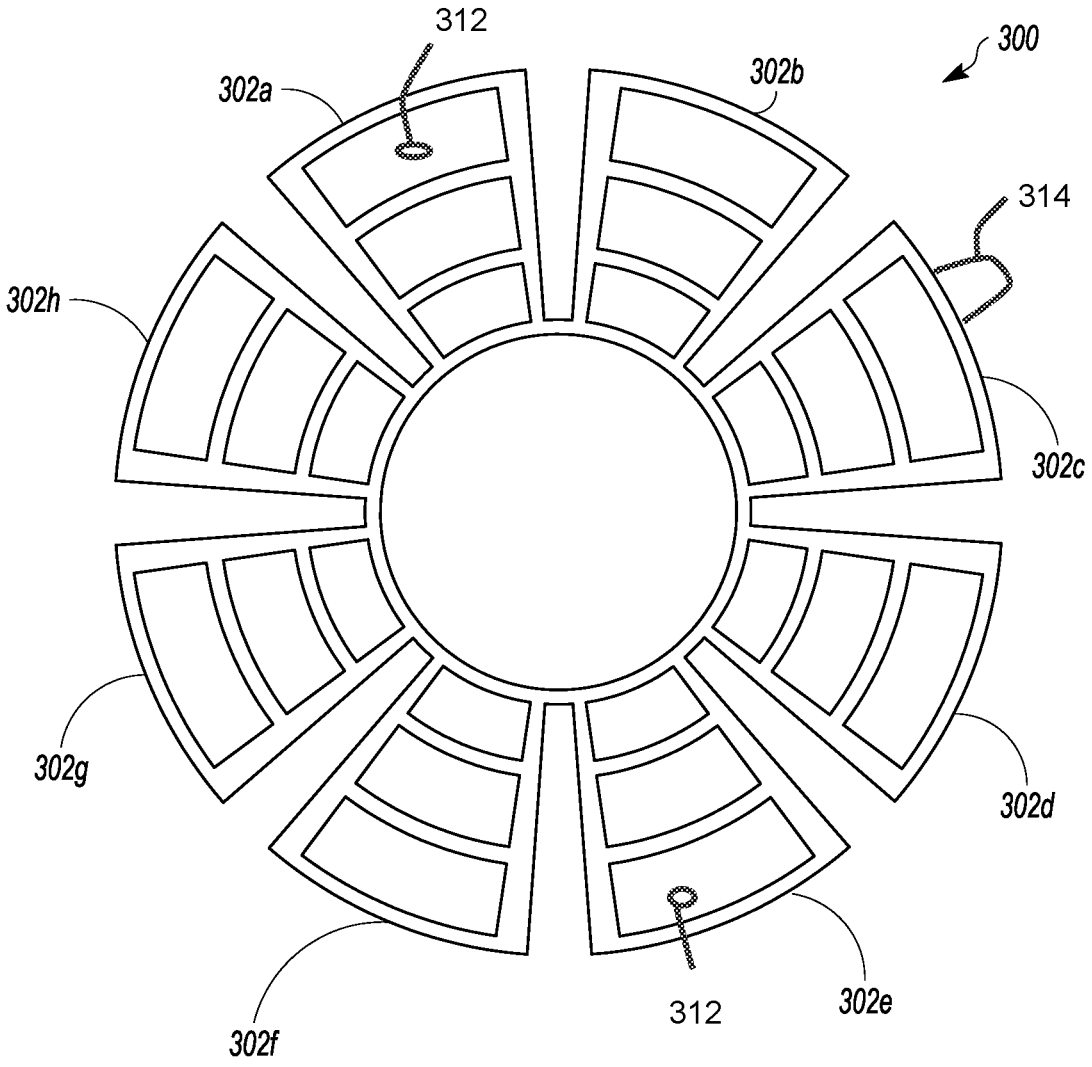
FIG. 7A shows a top view of an exemplary refrigeration element for incorporation into the food storage system in accordance with some embodiments.
Figure 7B:
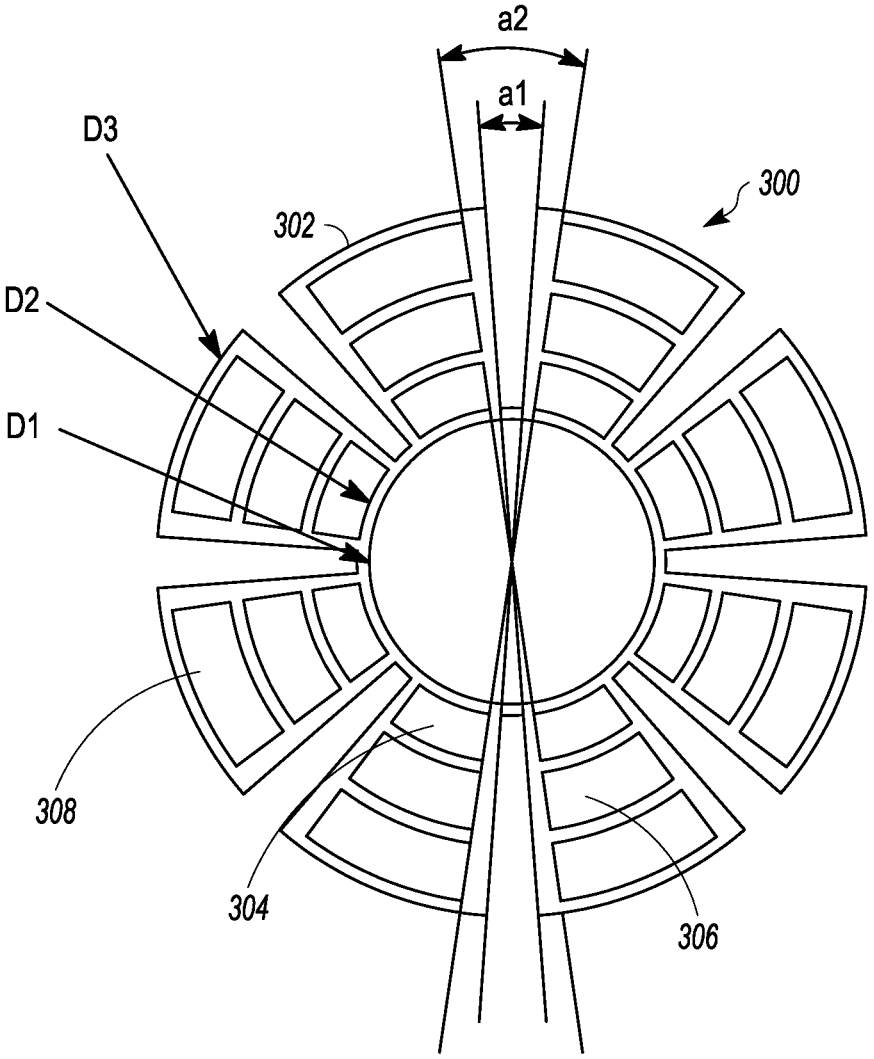
FIG. 7B shows further details of the exemplary refrigeration element shown in FIG. 7A in accordance with some embodiments.

FIGS. 7A-7B show exemplary embodiments of a refrigeration element 300 for incorporation into the food storage systems in accordance with some embodiments. The refrigeration element 300 includes a plurality of refrigeration sections or fingers 302, wherein the refrigeration sections 302 are configurable to cause the refrigeration element 300 to hug a bowl, for example bowl 10*a*, when the refrigeration element 300 is inserted in void 1*a*. In FIGS. 7A-7B, eight refrigeration sections 302*a*-302*h* are shown with each section having a plurality of freezable sections 304, 306, 308 incorporated in at least three areas of each refrigeration section 302. As is obvious, the refrigeration element 300 may include more or less than eight refrigeration sections 302, each of which may include more or less freezable sections than shown in FIGS. 7A-7B. Freezable substance, for example freezable gel, may be incorporated in the freezable sections 304, 306, 308, wherein the freezable gels are preferably food grade and can maintain a predefined temperature for a predefined period of time. For example, the freezable gels may maintain a temperature of approximately 30-45 degrees Fahrenheit for up to 5 hours. The refrigeration element 300 may include one or more attachment members, for example, one or more suctions 312, loops 314 or other means, for attaching the refrigeration element 300 to, for example bowl 10*a* or 10*z*.

Figure 8:
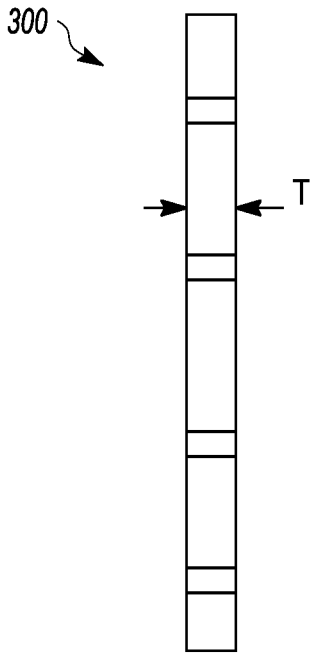
FIG. 8 shows a side view of the exemplary refrigeration element shown in FIG. 7B in accordance with some embodiments.
Figure 9:
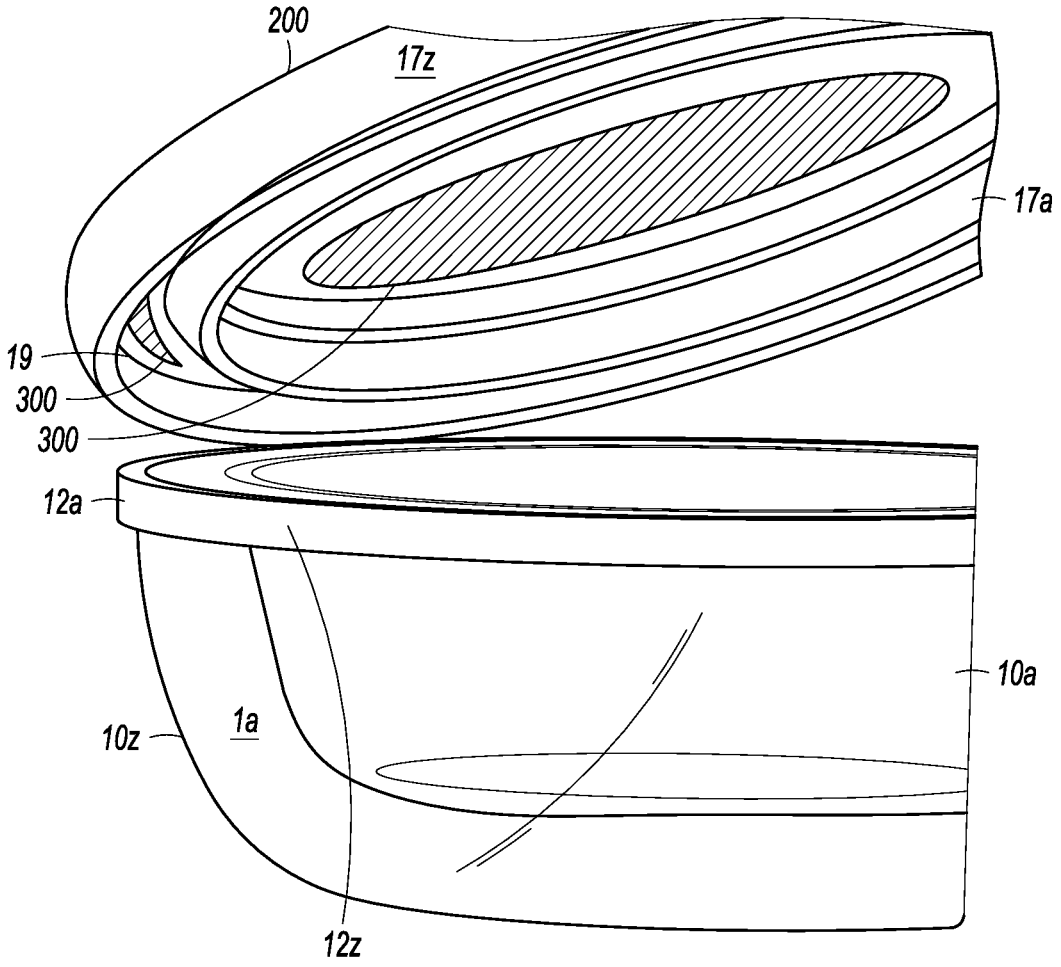
FIG. 9 shows another front perspective view of the plurality of nestable bowls and a connection element in accordance with some embodiments Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

Variables that can define the refrigeration element 300 include the thickness of the walls of the sections, shown as D1, D2, D3, and the spacing between the sections 302, shown as a1, a2, as shown for example in FIG. 7B. FIG. 8 shows a side view of the exemplary refrigeration element shown in FIG. 7B, having an overall thickness T.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter

I claim:

1. A food storage system, comprising:

a plurality of bowls; and a connection element comprising a gripping member including notches configured to couple to at least two of the bowls; and wherein when two bowls are nested and coupled to the connection element, a void is formed between the two nested bowls and a refrigeration element is positionable in the void to maintain an internal temperature in the nested bowl, wherein the gripping member is configured to connect with an annular element of each bowl such that the void is disposed between two nested bowls and the gripping member is configurable such that the notches are increased or decreased depending on a number of bowls being nested.

2. The food storage system of claim 1, further comprising a protection element configured to couple to the connection element and to protect contents of the food storage system.

3. The food storage system of claim 2, wherein at least one of the plurality of bowls, the connection element, and the protection element is manufactured from a material that includes a temperature indicator and is configured to provide an alert when a temperature in one or more of the plurality of bowls rises above a predefined temperature.

4. The food storage system of claim 2, wherein at least one of the plurality of bowls, the connection element, and the protection element is coupled to a temperature indicator and the food storage system is configured to provide an alert when a temperature in one or more of the plurality of bowls rises above a predefined temperature.

5. The food storage system of claim 1, wherein each bowl further comprises at least one annular element configured to couple the bowl with the connection element.

6. The food storage system of claim 1, wherein the connection element includes coupling elements, each of which is configured for snap-like connection with an annular element of each bowl such that the void is disposed between two nested bowls.

7. The food storage system of claim 1, wherein the connection element is positioned within a protection element configured to protect contents of the food storage system.

8. The food storage system of claim 1, wherein the refrigeration element is configured to couple to at least one nested bowl.

9. The food storage system of claim 1, wherein the refrigeration element comprises a plurality of refrigeration sections configurable to cause the refrigeration element to hug a nested bowl.

10. The food storage system of claim 9, wherein each refrigeration section comprises a plurality of freezable sections configured to incorporate freezable substance that can maintain a predefined temperature for a predefined time period.

11. The food storage system of claim 1, wherein the refrigeration element comprises an attachment member for attaching the refrigeration element to a nested bowl.

12. The food storage system of claim 1, wherein the connection element includes a top outermost surface positionable within at least a portion of a protection element.

13. The food storage system of claim 1, wherein the connection element includes at least two coupling elements.

14. The food storage system of claim 13, wherein each coupling element further comprises an annular lip and an inner annular extension, wherein the annular lip and the inner annular extension are positioned within the connection element such that an innermost annular groove is formed in the connection element.

15. A food storage system, comprising:

a plurality of bowls; and a protection element configured to protect contents of the food storage system, the protection element comprising one or more annular sections, wherein when two bowls are nested and coupled to the annular sections, a void is formed between the two nested bowls and a refrigeration element is positionable in the void to maintain an internal temperature in the nested bowl, wherein the protection element further comprises a plurality of nestable protection members, having refrigeration elements positionable within one or more annular sections.

* * * * *